US010693253B2

(12) United States Patent
Zhu et al.

(10) Patent No.: US 10,693,253 B2
(45) Date of Patent: Jun. 23, 2020

(54) MOVABLE SOCKET ASSEMBLY

(71) Applicant: SHANUTEC (SHANGHAI) CO., LTD., Shanghai (CN)

(72) Inventors: Wenting Zhu, Shanghai (CN); Nan Luo, Shanghai (CN); Quangang Zhang, Shanghai (CN); Guoxin Wu, Shanghai (CN); Jie Zhang, Shanghai (CN); Bowei Lu, Shanghai (CN); Panpan Zhou, Shanghai (CN); Xiaoqiao Shen, Shanghai (CN)

(73) Assignee: SHANUTEC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/398,224

(22) Filed: Apr. 29, 2019

(65) Prior Publication Data

US 2019/0260148 A1 Aug. 22, 2019

Related U.S. Application Data

(63) Continuation of application No. 15/745,427, filed as application No. PCT/CN2016/085142 on Jun. 7, 2016, now Pat. No. 10,312,622.

(30) Foreign Application Priority Data

Jul. 28, 2015 (CN) ..... 2015 1 0451677
Aug. 19, 2015 (CN) ..... 2015 1 0512159

(51) Int. Cl.
*H01R 33/00* (2006.01)
*H01R 13/24* (2006.01)
(Continued)

(52) U.S. Cl.
CPC ..... *H01R 13/2464* (2013.01); *H01R 13/4538* (2013.01); *H01R 13/502* (2013.01);
(Continued)

(58) Field of Classification Search
CPC ..... H01R 13/2464; H01R 13/502; H01R 25/142; H01R 13/4538; H01R 24/78; H01R 13/60; H01R 31/02
(Continued)

(56) References Cited

U.S. PATENT DOCUMENTS 5,183,406 A * 2/1993 Glen ..... H01R 25/14 439/120
7,374,444 B1 * 5/2008 Bennett ..... H01R 13/652 439/215
(Continued)

FOREIGN PATENT DOCUMENTS

CN 2049411 U 12/1989
CN 2137036 Y 6/1993
(Continued)

OTHER PUBLICATIONS

International Search Report in PCT/CN2016/085142 dated Sep. 13, 2016, 4 Pages.
(Continued)

*Primary Examiner* — Abdullah A Riyami
*Assistant Examiner* — Nelson R. Burgos-Guntin
(74) *Attorney, Agent, or Firm* — Metis IP LLC

(57) ABSTRACT

The present disclosure relates to a movable socket assembly. The movable socket assembly may include a housing, a plug part installed in said housing, a plurality of elastic conducting contact points formed on said plug part, and an adjusting mechanism for positioning the plug part out of the housing so that the plug part can be removably inserted into an external power outlet. The housing may further include a first housing and a second housing, and the second housing can retract into the first housing to extend the flat insertion piece out of the housing through an opening of the second housing.

20 Claims, 11 Drawing Sheets

(51) Int. Cl.

| | |
|---|---|
| ***H01R 13/453*** | (2006.01) |
| ***H01R 24/78*** | (2011.01) |
| ***H01R 25/14*** | (2006.01) |
| ***H01R 13/60*** | (2006.01) |
| ***H01R 13/502*** | (2006.01) |
| *H01R 31/02* | (2006.01) |

(52) U.S. Cl.
CPC ..... *H01R 13/60* (2013.01); *H01R 24/78* (2013.01); *H01R 25/142* (2013.01); *H01R 31/02* (2013.01)

(58) Field of Classification Search
USPC ..... 439/106, 107, 638, 717, 155
See application file for complete search history.

(56) References Cited

U.S. PATENT DOCUMENTS

| | | | | |
|---|---|---|---|---|
| 7,488,204 | B2 * | 2/2009 | Hsu | H01R 25/003 439/106 |
| 8,469,726 | B2 * | 6/2013 | Perales Fayos | H01R 25/142 439/110 |
| 8,870,601 | B2 * | 10/2014 | Lee | H01R 31/06 439/131 |
| 8,896,150 | B1 * | 11/2014 | Shammoh | H01R 13/70 307/31 |
| 9,124,308 | B2 * | 9/2015 | Metcalf | A47C 7/70 |
| 9,190,791 | B1 * | 11/2015 | Jaena | H01R 25/162 |
| 9,716,357 | B2 * | 7/2017 | Zhu | H01R 24/00 |
| 9,912,100 | B2 * | 3/2018 | Zantout | H01R 13/6205 |
| 2002/0011434 | A1 * | 1/2002 | Kuennen | A61L 2/10 210/97 |
| 2003/0224636 | A1 * | 12/2003 | Lorenzen | H01R 25/14 439/110 |
| 2004/0048519 | A1 * | 3/2004 | Glusing | G06K 19/07743 439/638 |
| 2009/0011652 | A1 * | 1/2009 | Koh | H01R 13/6205 439/638 |
| 2014/0094065 | A1 * | 4/2014 | Martin | H01R 13/72 439/638 |
| 2014/0273567 | A1 * | 9/2014 | Huang | H01R 13/4538 439/157 |
| 2016/0294132 | A1 | 10/2016 | Zhu | |

FOREIGN PATENT DOCUMENTS

| | | | |
|---|---|---|---|
| CN | 201417846 | Y | 3/2010 |
| CN | 201797109 | U | 4/2011 |
| CN | 202333282 | U | 7/2012 |
| CN | 203056221 | U | 7/2013 |
| CN | 203839636 | U | 9/2014 |
| CN | 203859355 | U | 10/2014 |
| CN | 204257874 | U | 4/2015 |
| CN | 104993267 | A | 10/2015 |
| CN | 105048165 | A | 11/2015 |
| CN | 204927630 | U | 12/2015 |
| EP | 1703782 | A1 | 9/2006 |
| EP | 2897236 | A1 | 7/2015 |

OTHER PUBLICATIONS

Written Opinion in PCT/CN2016/085142 dated Sep. 13, 2016, 5 Pages.
First Office Action in Chinese Application No. 201510451677.1 dated Jun. 23, 2016, 8 Pages.
First Office Action in Chinese Application No. 201510512159,6 dated Dec. 21, 2016, 15 Pages.
The Extended European Search Report in European Application No. 16829691.1 dated Jun. 15, 2018, 8 Pages.

* cited by examiner

MOVABLE SOCKET ASSEMBLY

CROSS-REFERENCE TO RELATED APPLICATIONS

This application is a continuation of U.S. patent application Ser. No. 15/745,427, filed on Jan. 16, 2018, which is a U.S. national stage application of International Application No. PCT/CN2016/085142, filed on Jun. 7, 2016, which claims priority of Chinese Application No. 201510451677.1 filed on Jul. 28, 2015, and Chinese Application No. 201510512159.6 filed on Aug. 19, 2015, the entire contents of each of which are hereby incorporated by reference.

TECHNICAL FIELD

The present disclosure relates to a movable socket assembly.

BACKGROUND

Socket is widely used in our daily life. Traditional socket assembly is generally fixed at a location and has a limited number of outlets. If an electrical equipment is located far away from the socket assembly or the number of outlets is not enough, then a socket/outlet strip and additional power cord are needed. This is less flexible and the messy power cords may cause potential safety issues in a house. Installing additional sockets on a wall complicates the wiring inside the wall. And it is difficult to predict the number of sockets that will be needed in the future. For this reason, there is a need for a type of socket assembly with more flexibility and removability.

SUMMARY

According to one aspect of the present disclosure, provided herein is a movable socket assembly. Particularly, in some embodiments, the movable socket assembly comprises a housing, a plug part installed in said housing, a plurality of elastic conducting contact points formed on said plug part, and an adjusting mechanism for positioning the plug part out of the housing so that the plug part can be removably inserted into an external power outlet.

In some embodiments, the plug part comprises a flat insertion piece having two insulation layers and a plurality of conducting strips placed between the two insulation layers, and each conducting strip penetrates one of the two insulation layers to form one of the plurality of elastic conducting contact points at a surface of said insulation layer.

In some embodiments, the movable socket assembly comprises a plurality of holes formed on a side of the housing for receiving an external plug.

In some embodiments, the plurality of elastic conducting contact points are formed on a same side of the flat insertion piece.

In some embodiments, the plurality of elastic conducting contact points are formed on different sides of the flat insertion piece.

In some embodiments, each elastic conducting contact point has one of a curved surface, a plane surface, a waved surface, and a stepped surface.

In some embodiments, the adjusting mechanism comprises a slide guide and a spring for ejecting the flat insertion piece out of the housing along the slide guide.

In some embodiments, the movable socket assembly comprises a locking mechanism for locking the flat insertion piece into a position.

In some embodiments, the locking mechanism comprises a button, a second spring, and a lock key, wherein the second spring can push the lock key to engage a notch formed on the flat insertion piece to lock the flat insertion piece into the position, and wherein the button can push the lock key to disengage the notch to unlock the flat insertion piece from the position.

In some embodiments, the flat insertion piece further comprises a bulge which stops the flat insertion piece from being completely ejected from the housing.

In some embodiments, the movable socket assembly comprises a safety unit. The safety unit comprises a gate installed between the plurality of holes and a plurality of conductors, a spring attached to the gate, and a slope formed on the gate. When the external plug is inserted into the holes the external plug engages with the slope to push the gate aside so that the external plug can connect to the plurality of conductors.

In some embodiments, the housing of the movable socket assembly comprises a first housing and a second housing, and the second housing can retract into the first housing to extend the flat insertion piece out of the housing through an opening of the second housing.

In some embodiments, the adjusting mechanism comprises a spring for ejecting the second housing out of the first housing when the flat insertion piece is being removed from the external power outlet.

In some embodiments, the second housing of the movable socket assembly comprises an upper housing portion which has a safety unit mount part, a lower housing portion which has a socket core structure, and a bottom portion.

In some embodiments, the second housing of the movable socket assembly comprises a bulge for preventing the second housing from completely disengage the first housing, and wherein said bulge is formed at an end of the upper housing portion.

In some embodiments, the housing of the movable socket assembly comprises a chamber for installing a smart chip.

DETAILED DESCRIPTION

Figure 1:
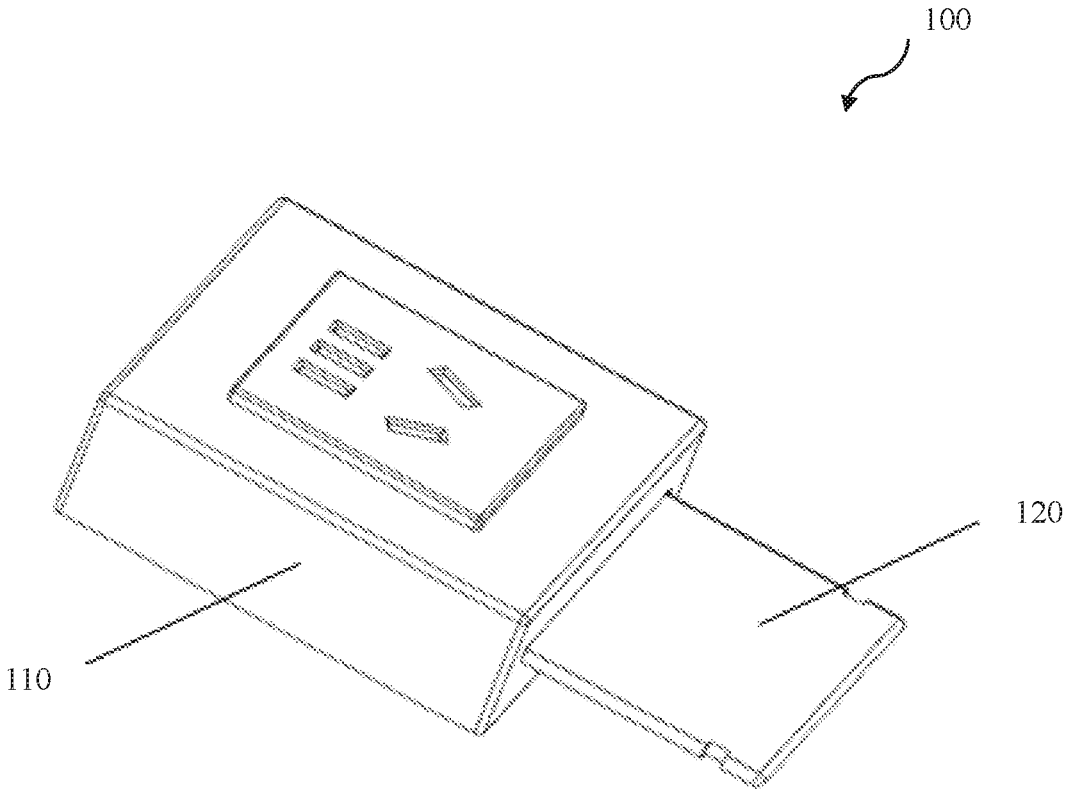
FIG. 1 illustrates an exemplary embodiment of a movable socket assembly in accordance with some embodiments of the disclosed subject matter.

In the following detailed description, numerous specific details are set forth by way of examples in order to provide a thorough understanding of the relevant disclosure. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

These and other features, and characteristics of the present disclosure, as well as the methods of operation and functions of the related elements of structure and the combination of parts and economies of manufacture, may become more apparent upon consideration of the following description with reference to the accompanying drawing(s), all of which form a part of this specification. It is to be expressly understood, however, that the drawing(s) are for the purpose of illustration and description only and are not intended to limit the scope of the present disclosure. As used in the specification and in the claims, the singular forms of "a", "an", and "the" include plural references unless the context clearly dictates otherwise.

After reading this description, it will become apparent to one skilled in the art how to implement the disclosure in various alternative embodiments and alternative applications. However, not all embodiments of the present disclosure are specifically described herein. It will be understood that the embodiments are presented by way of example only, and not limitation. As such, this detailed description of various alternative embodiments should not be construed to limit the scope or breadth of the present invention as set forth below.

According to one aspect of the present disclosure, provided herein are movable socket assemblies. FIG. 1 illustrates an exemplary embodiment of a movable socket assembly 100 in accordance with some embodiments of the disclosed subject matter. As illustrated in FIG. 1, the movable socket assembly 100 includes a housing 110, a plug part 120 and any other suitable components (not shown in FIG. 1) in accordance with the disclosed subject matter. The housing 110 protects the components of the movable socket assembly 100. When in use, the plug part 120 is extended out of the housing 110 so that the plug part can be removably inserted into an external power outlet.

Figure 2:
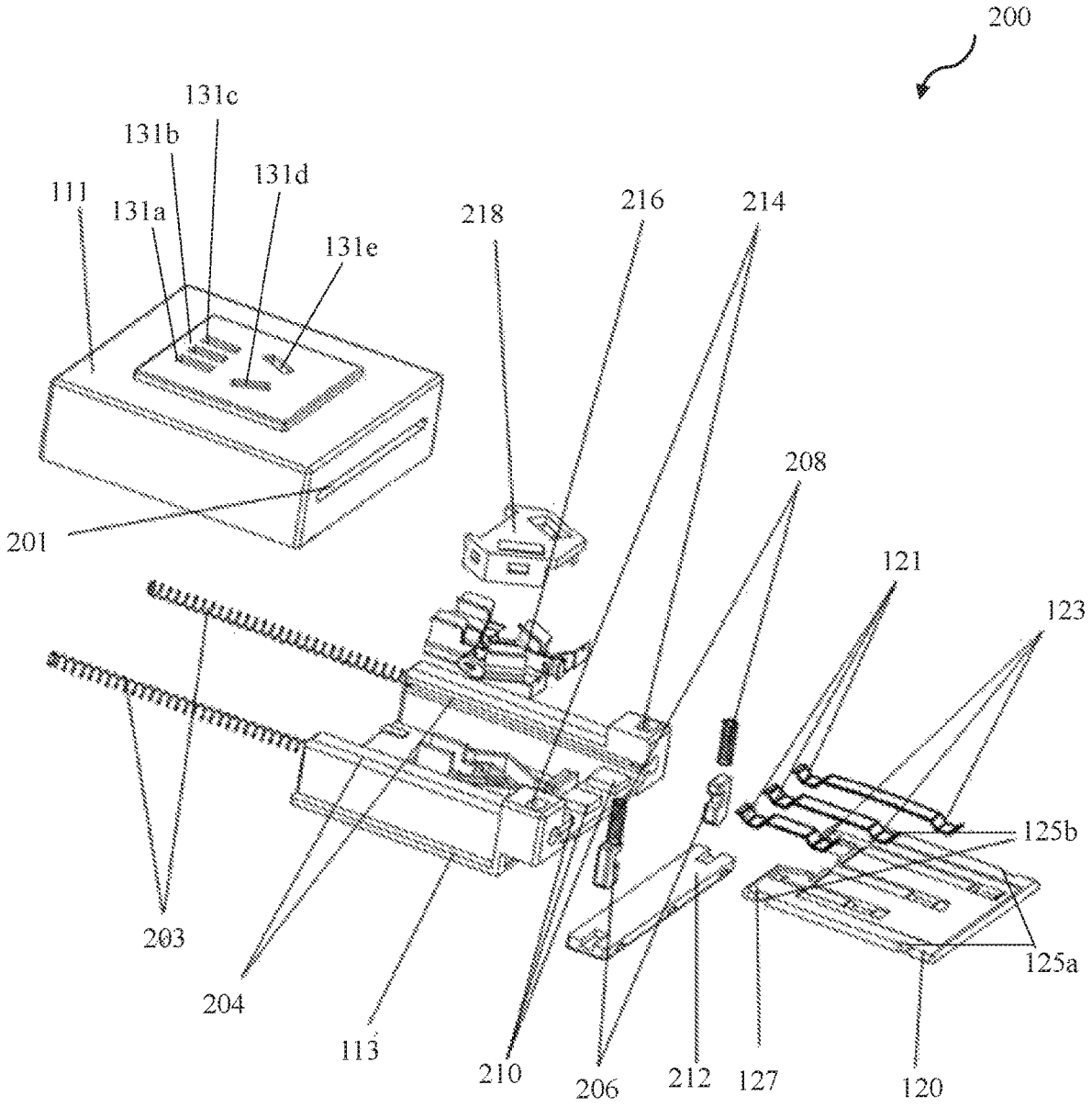
FIG. 2 illustrates a partial exploded view of a movable socket assembly in accordance with some embodiments of the disclosed subject matter.

FIG. 2 illustrates a partial exploded view of a movable socket assembly 100 in accordance with some embodiments of the disclosed subject matter.

In one embodiment, the housing 110 includes a front housing portion 111 and a rear housing portion 113. The front housing portion 111 and the rear housing portion 113 are attached to each other to enclose the components installed inside the housing 110. The front housing portion 111 has a housing opening 201 through which the plug part 120 can be extended out of the housing 110.

In one embodiment, a plurality of holes 131*a-e* are formed on a side of the front housing portion 111. The movable socket assembly 100 further includes a socket core structure 218 and a plurality of conductors 216. Together, the plurality of holes 131*a-e*, the socket core structure 218, and the plurality of conductors 216 work as a socket for receiving an external plug. In a different embodiment, a separate socket part or a different electronic device (e.g., a router, a sensor, an alarm, a probe, a detector, a camera, a charger, or a converter) may be attached to the movable socket assembly.

The plurality of holes 131*a-e* may be formed on a same side of the front housing portion 111 (e.g., on the top side of the front housing portion 111). Alternatively, the plurality of holes 131*a-e* may be formed on different sides of the front housing portion 111. For example, holes 131*a* and 131*b* may be on one side of the front housing portion 111, and holes 131*c*, 131*d* and 131*e* may be formed on a different side of the front housing portion 111.

In one embodiment, the movable socket assembly 200 has an adjusting mechanism for extending the plug part 120 out of the housing 110. The adjusting mechanism may be formed on the front housing portion 111 or the rear housing portion 113. For example, the rear housing portion 113 has a slide guide 204 on each side of the rear housing portion 113. A spring 203 is placed in each slide guide 204. One end of the spring 203 connects to the plug part 120 so that it can eject the plug part 120 out of the housing 110 for insertion into an external power outlet. The plug part 120 may slide in the housing 110 along the slide guide 204.

In one embodiment, a button 212 and a switch container 214 are installed on one end of the rear housing portion 113. The switch container 214 may be formed as part of the rear housing portion 113. The button 212 is connected to the switch container 214 through the lock key 206 and a spring 208. A pair of front notches 125*a* are formed on the front end of the plug part 120 and a pair of back notches 125*b* are formed on the rear end of the plug part 120. When the button 212 is not pressed, each spring 208 pushes down the corresponding lock key 206 to engage a front notch 125*a* to lock the plug part 120 inside the housing 110. When the button 212 is pressed, the button 212 pushes up each lock key 206 to disengage the corresponding front notch 125*a*. The plug part 120 is therefore unlocked and may be ejected out of the housing 110 through the housing opening 201 by the spring 203. A bulge 127 is formed on the rear end of the plug part 120 so that the front housing portion 111 can stop it from being completely ejected out of the housing 110. Once the button 212 is released, the pressure of the springs 208 pushes down the lock keys 206 to engage with the back notches 125*b* to lock the plug part 120 so that it may be inserted into an external power outlet.

In one embodiment, the plug part 120 is a flat insertion piece which has one or more insulation layers and a plurality of conducting strips. For example, the plug part 120 may have two insulation layers and three conducting strips placed between the two insulation layers. Each conducting strip has one end penetrating an insulation layer to form an elastic conducting contact point 123 on the outer surface of the insulation layer. Alternatively, the elastic contacting point 123 may be separately formed on the outer surface of an insulation layer and is then connected to the stripe. The plurality of elastic conducting contact points 123 may be formed on the same side or different sides of the plug part 120. The plurality of elastic conducting contact points 123 may be formed on one or more sides of the plug part 120. In addition, they may be arranged horizontally, diagonally, or in a different configuration on the surface of the plug part 120 if the insertion direction is the downward direction. When the plug part 120 is inserted into an external power outlet, the plurality of elastic conducting contact points 123 are electrically connected to the electrical wires to receive electricity.

The other end of each conducting strip may form a similar elastic conducting contact point 121. When the plug part 120 is fully ejected, these elastic conducting contact points 121 are electrically connected to a plurality of fixed contact points 210, which in turn are connected to the conductors 216. Further detailed disclosure regarding the elastic conducting contact point 121 is provided in FIGS. 5A and 5B and related descriptions below.

The structures and functions described above in relation to the movable socket assembly 100 are not exhaustive and are not limiting; numerous other changes, substitutions, variations, alterations, and modifications may be ascertained to one skilled in the art and it is intended that the present disclosure encompasses all such changes, substitutions, variations, alterations, and modifications as falling within the scope of the appended claims.

Figure 3:
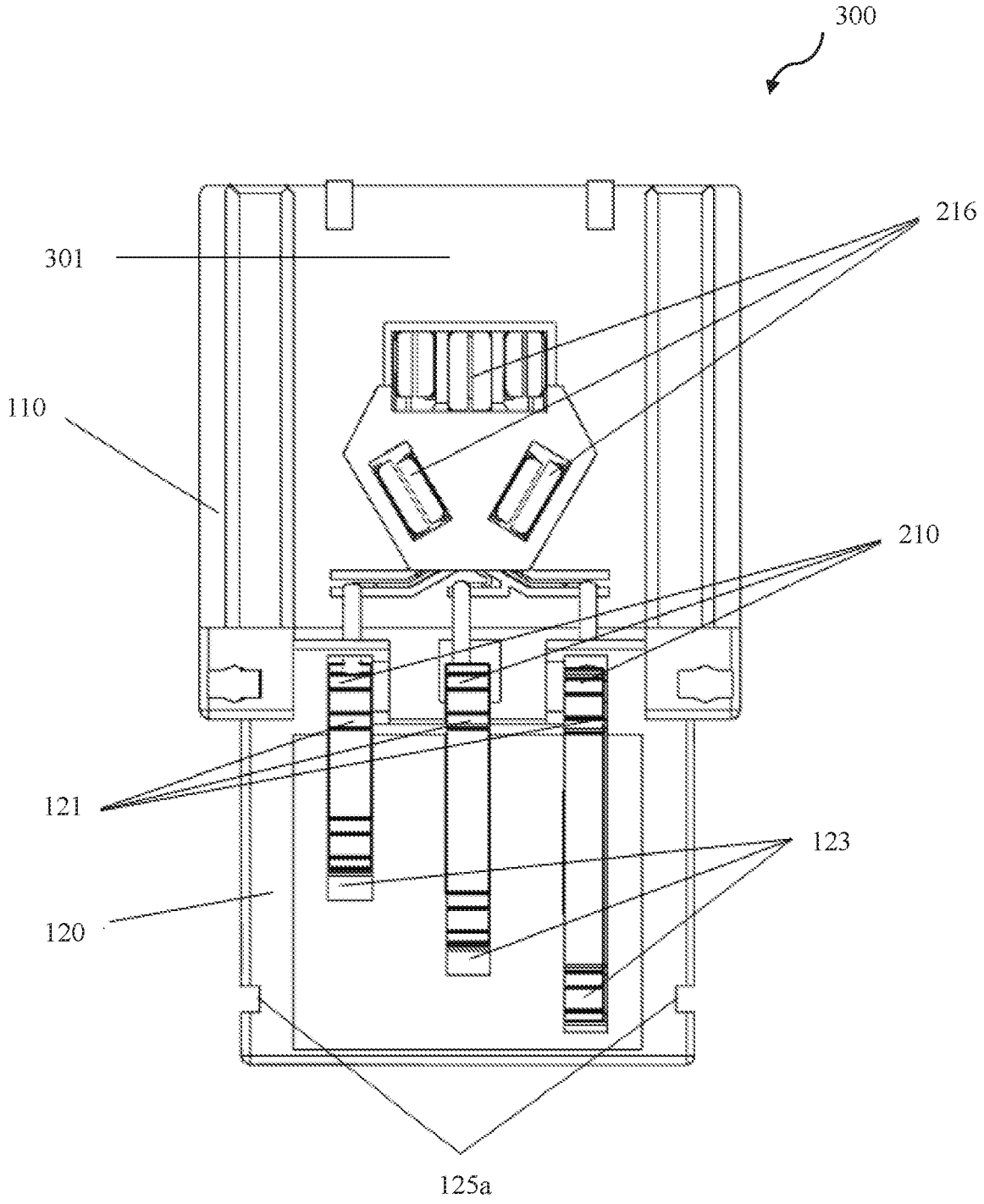
FIG. 3 illustrates a partial front view of part of a movable socket assembly in accordance with some embodiments of the disclosed subject matter.

FIG. 3 illustrates a partial front view of part of a movable socket assembly 100 in accordance with some embodiments of the disclosed subject matter. As illustrated in FIG. 3 the housing 110 further includes a chamber 301. The chamber 301 may be configured to install a smart chip.

Figure 4A:
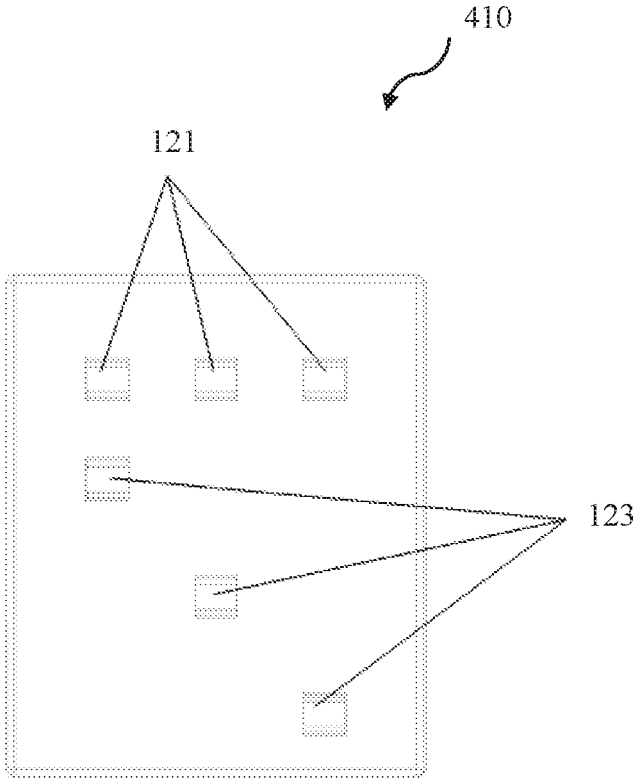
FIG. 4A illustrates a front view of the plug part in accordance with some embodiments of the disclosed subject matter.
Figure 4B:
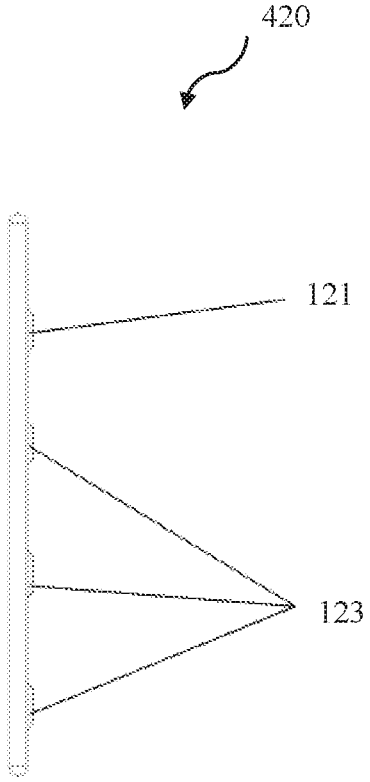
FIG. 4B illustrates a side view of the plug part in accordance with some embodiments of the disclosed subject matter.

FIG. 4A illustrates a front view of the plug part 120 in accordance with some embodiments of the disclosed subject matter. FIG. 4B illustrates a side view of the plug part 120 in accordance with some embodiments of the disclosed subject matter.

In one embodiment, the plug part 120 has three elastic contact points 121 arranged in-line horizontally on the surface of the plug part 120 for connecting to the fixed contact points 210 (shown in FIG. 2) and three elastic conducting contact points 123 arranged diagonally on the surface of the plug part 120 for connecting to the electrical wires in an external power outlet. As long as these elastic conducting contact points are connected to the correct conductor/wire and they do not interfere with each other when the plug part 120 is inserted into an external power outlet, they may be arranged in a different configuration on the surface of the plug part 120. Further detailed disclosure regarding the elastic conducting contact point 123 is provided in FIGS. 5A and 5B and related descriptions below.

Figure 5A:
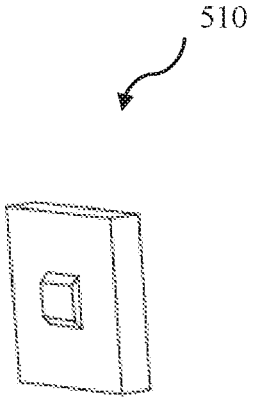
FIGS. 5A and 5B illustrate two exemplary elastic conducting contact points in accordance with some embodiments of the disclosed subject matter.
Figure 5B:
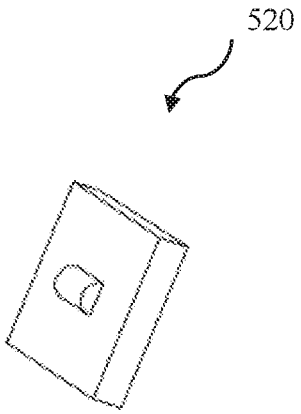

FIGS. 5A and 5B illustrate two exemplary elastic conducting contact points 121 and 123 in accordance with some embodiments of the disclosed subject matter. The elastic conducting contact point 121*s* and/or 123 may have any shape (e.g., a curved surface, a plane surface, a waved surface, or a stepped surface) for a larger contact area. In one embodiment, as shown in FIG. 5A, the elastic conducting contact points 121 and/or 123 has a stepped surface. In another embodiment, as shown in FIG. 5B, the elastic conducting contact points 121 and/or 123 has a curved surface. Each of the plurality of the elastic conducting contact points 121 and/or 123 may have a same type of surface or different types of surfaces. In one embodiment, two of the elastic conducting contact points 121 may have a stepped type surface, and the third elastic conducting contact point 121 may have a curved type surface.

Figure 6:
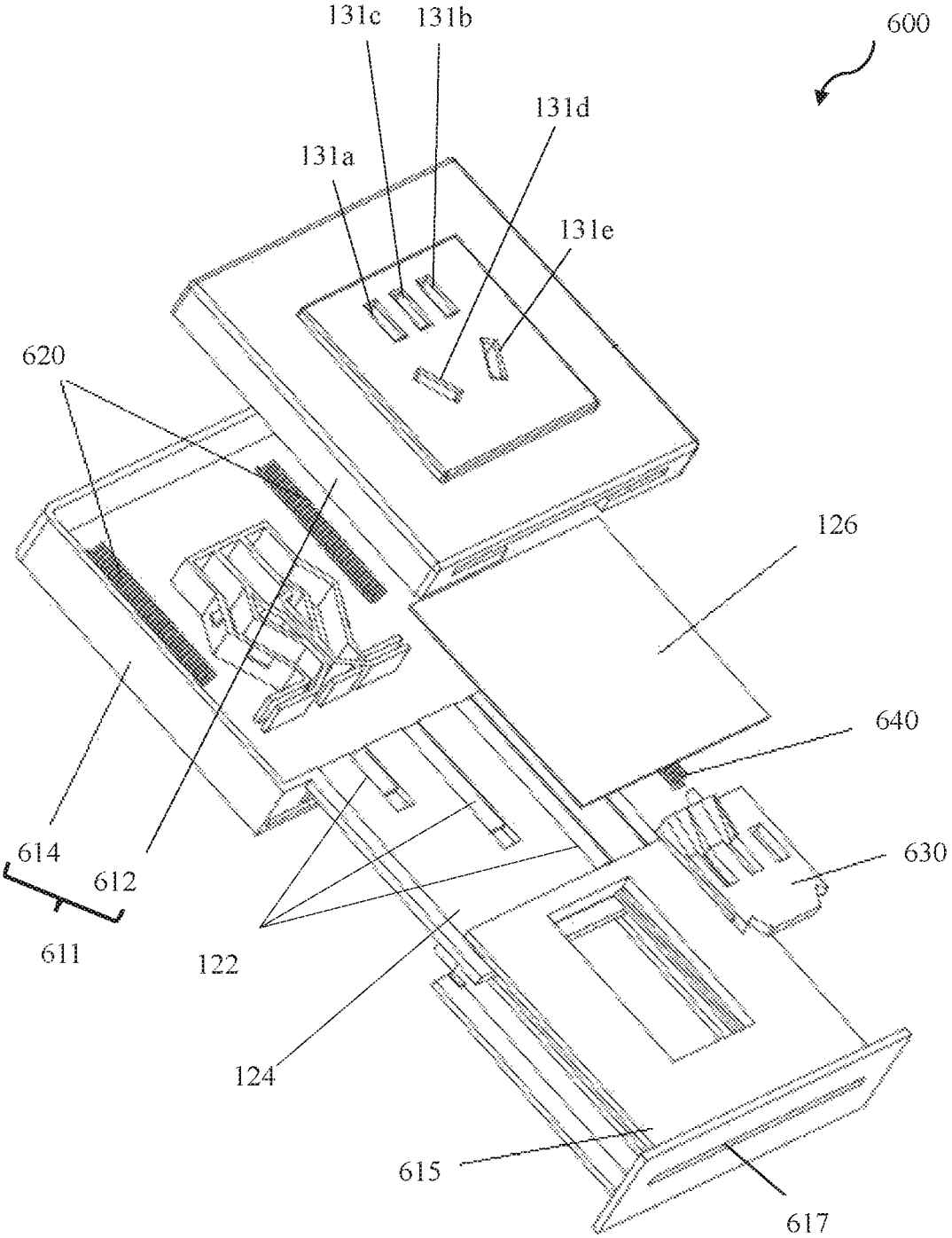
FIG. 6 illustrates a partial exploded view of a movable socket assembly in accordance with some embodiments of the disclosed subject matter.

FIG. 6 illustrates a partial exploded view of a movable socket assembly 600 in accordance with some embodiments of the disclosed subject matter.

As illustrated in FIG. 6, the movable socket assembly 600 includes a front housing portion 612, a rear housing portion 614, a second housing 615 and any other suitable components in accordance with the disclosed subject matter.

The front housing portion 612 and the rear housing portion 614 are attached together to form a first housing. In one embodiment, a plug part, whose structure may be similar to the plug part 120 shown in FIGS. 2, 3, 4A, 4B, 5A and 5B, is fixed to the first housing.

Figure 7:
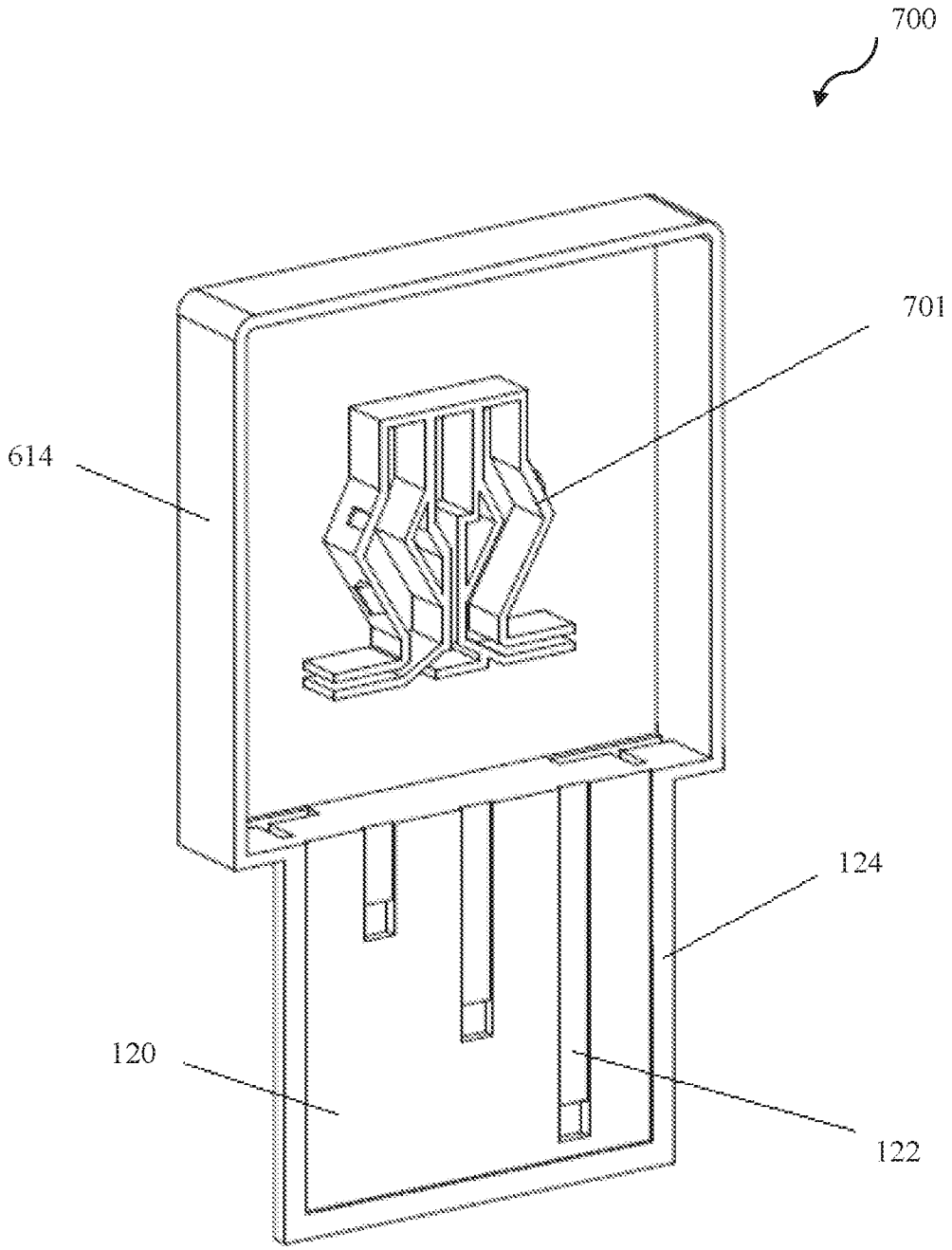
FIG. 7 illustrates a partial front view of part of a movable socket assembly in accordance with some embodiments of the disclosed subject matter.

In one embodiment, a plurality of holes 131*a-e* are formed on a side of the front housing portion 612 and a socket core structure 701 (as shown in FIG. 7) is fixed to the rear housing portion 614. The plurality of holes 131*a-e*, the socket core structure 701, and the plurality of conductors installed in the socket core structure 701 work together as a socket part for receiving an external plug. A safety unit may be installed between the plurality of holes 131*a-e* and the socket core structure 701. The safety unit may include a safety gate spring 640 and a safety gate 630. The safety unit may be placed in the second housing 615 and slide in the second housing 615. When in use, the second housing 615 retracts into the first housing and the safety unit is positioned between the plurality of holes 131*a-e* and the socket core structure 701. When an external plug is inserted into the plurality holes 131*a-e*, it pushes the safety gate 630 aside and goes through the gate to connect to the conductors in the socket core structure 701. When the external plug is unplugged, the safety gate 630 is pulled back to its original position by the safety gate spring 640.

The second housing 615 is attached to the first housing to contain the plug part when the movable socket assembly is not in use. The second housing 615 may be pressed to slide into the first housing so that the plug part is extended out of the second housing 615 for insertion into an external power outlet. A pair of springs 620 are installed inside the first housing. One end of each spring 620 is attached to the rear housing portion 614, and the other end of the spring 620 is attached to the second housing 615. When the plug part is unplugged, the second housing 615 is pushed back to its original position by the springs 620 to fully contain the plug part again.

FIG. 7 illustrates a partial front view of part of a movable socket assembly 600 in accordance with some embodiments of the disclosed subject matter. As illustrated in FIG. 7, the movable socket assembly 600 further has a socket core structure 701, which may be formed as part of the rear housing portion 614, for holding a plurality of conductors (not shown in FIG. 7).

Figure 8A:
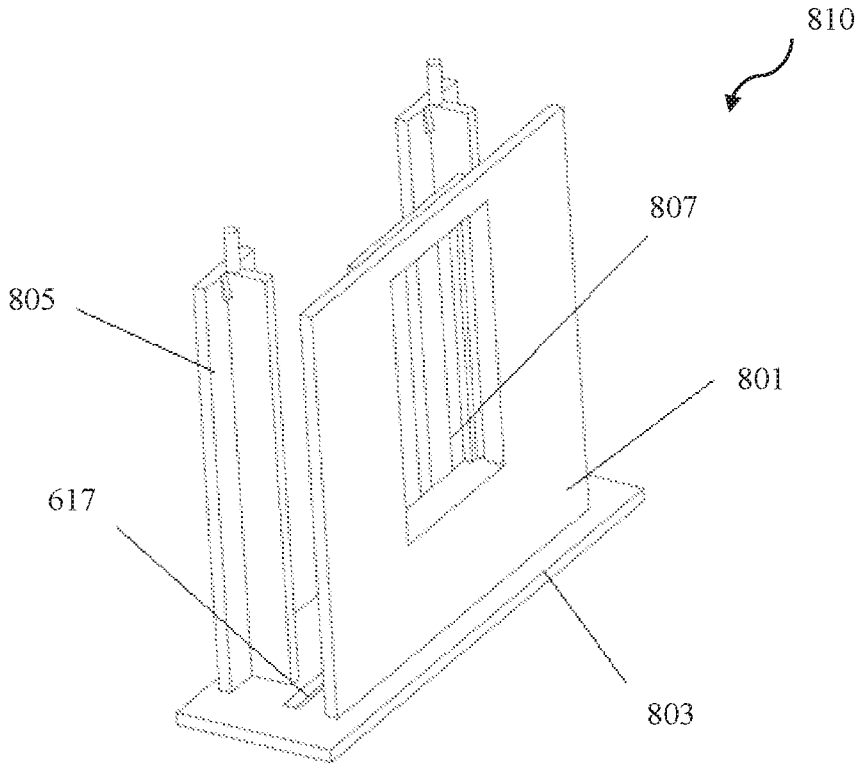
FIGS. 8A and 8B illustrate a part of the second housing in accordance with some embodiments of the disclosed subject matter.
Figure 8B:
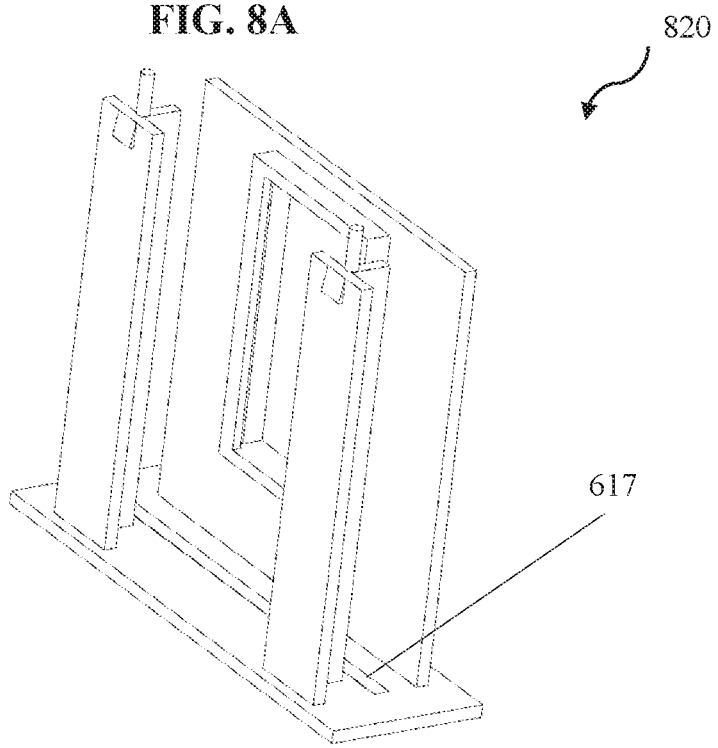

FIGS. 8A and 8B illustrate a part of the second housing 615 in accordance with some embodiments of the disclosed subject matter. As illustrated in FIGS. 8A and 8B, the second housing 615 further includes an upper housing portion 801, a bottom portion 803, and a lower housing portion 805. The upper housing portion 801 may slide into the front housing portion 612. The upper housing portion 801 may have a safety unit mount part 807 for holding a safety unit. The lower housing portion 805 may slide into the rear housing portion 614. The lower housing portion 805 may connect to the spring 620. The bottom portion 803 may have a housing opening 617. The lower housing portion 805 have two sliding boards in symmetry. Each of the sliding boards connect to a spring 620. A spring guide post of the spring 620 may be formed on the end of the connecting point for guiding the spring 620.

In one embodiment, the safety gate 630 may move in the safety unit mount part 807. The safety gate spring 640 is attached to the upper housing portion 801. The spring guide post of the safety gate spring 640 is on the end of the connecting point of the safety gate 630 and the safety gate spring 640.

Figure 9:
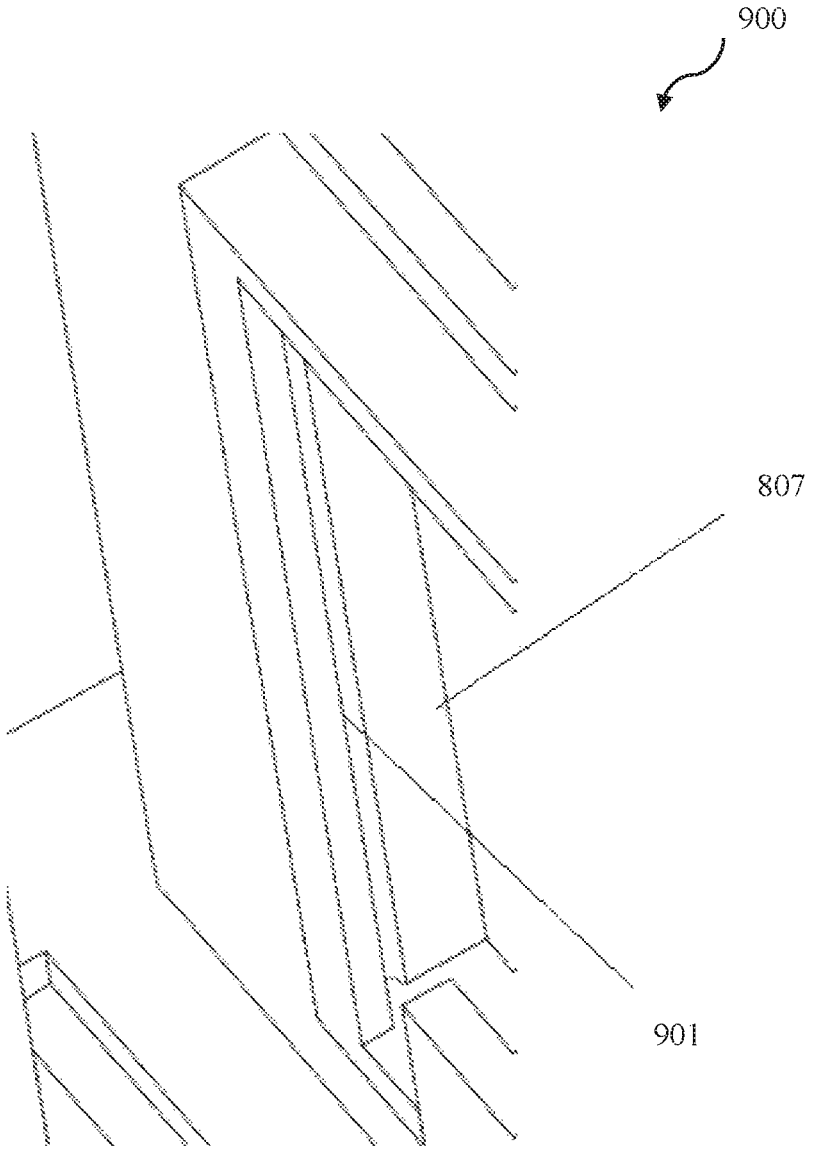
FIG. 9 illustrates a part of the upper housing portion in accordance with some embodiments of the disclosed subject matter.

FIG. 9 illustrates a part of the upper housing portion 801 in accordance with some embodiments of the disclosed subject matter. As illustrated in FIG. 9, the safety unit mount part 807 have a safety gate sliding groove 901. The safety gate 630 can slide along with the safety gate sliding groove 901.

Figure 10A:
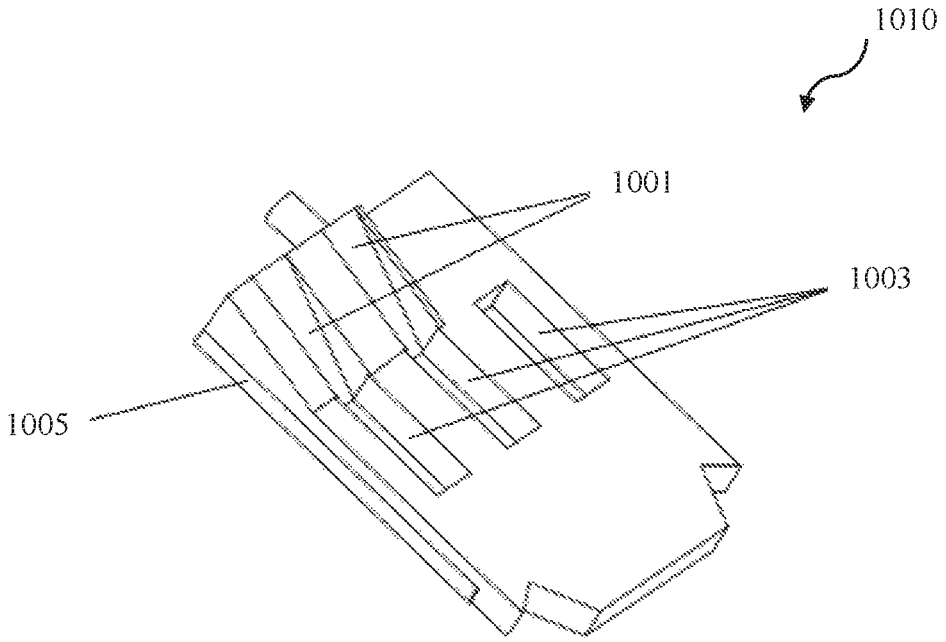
FIGS. 10A and 10B illustrate a part of a safety gate in accordance with some embodiments of the disclosed subject matter.
Figure 10B:
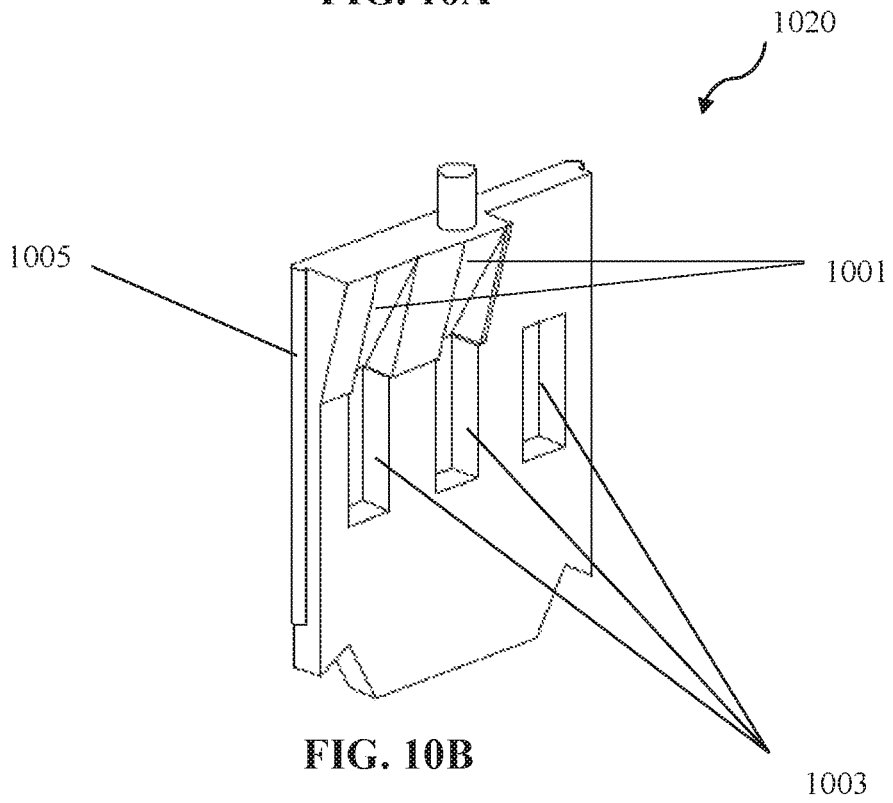

FIGS. 10A and 10B illustrate a part of a safety gate 630 in accordance with some embodiments of the disclosed subject matter. As illustrated in FIGS. 10A and 10B, a slope 1001 and a plurality of pass-through holes 1003 may be formed on the safety gate 630. The slope 1001 may only correspond to the holes (such as 131*a* and 131*b* as shown in FIG. 6) for the neutral line and earth line. When the plug part 120 is insert into the plurality of holes, the plug part 120 engages the slope 1001 and pushes the safety gate 630 to move so that the pass-through holes 1003 are aligned with the plurality of holes (such as 131*a-e* as shown in FIG. 6). The safety gate 630 may further include a guide 1005 that fits into the safety gate sliding groove 901. When an object is inserted into the hole corresponding to the hot wire (the right most hole in FIG. 10A), because there is no slope, the insertion force cannot be translated into a vertical force to move the safety gate 630 away. As such, the safety gate 630 prevents the object from connecting to the hot wire and no harm may be caused. When an object is inserted into the hole corresponding to the ground wire or neutral wire, the slope 1001 translates the insertion force into a vertical force, which moves the safety gate 630 to allow the object to go through the through holes to connect to the ground/neutral wire. However, because the ground/neutral wire does not have any voltage, there is no safety risk. When an external plug is inserted into the plurality of holes 131*a-e*, the plug's neutral leg or ground leg engages the slope to move aside the safety gate 630 so that the plug's hot leg can go through the through holes to connect to the hot wire. However, if the plug part 120 has not been fully inserted into the external power outlet, the safety gate 630 is not positioned deep enough into the first housing 611, the legs of the external plug still cannot go through the through holes.

Figure 11A:
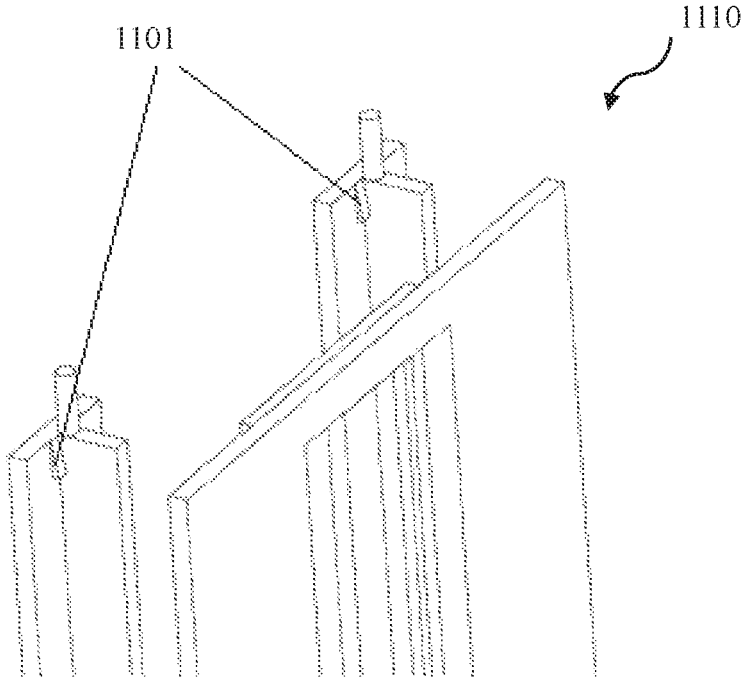
FIGS. 11A and 11B illustrate a part of a second housing in accordance with some embodiments of the disclosed subject matter.
Figure 11B:
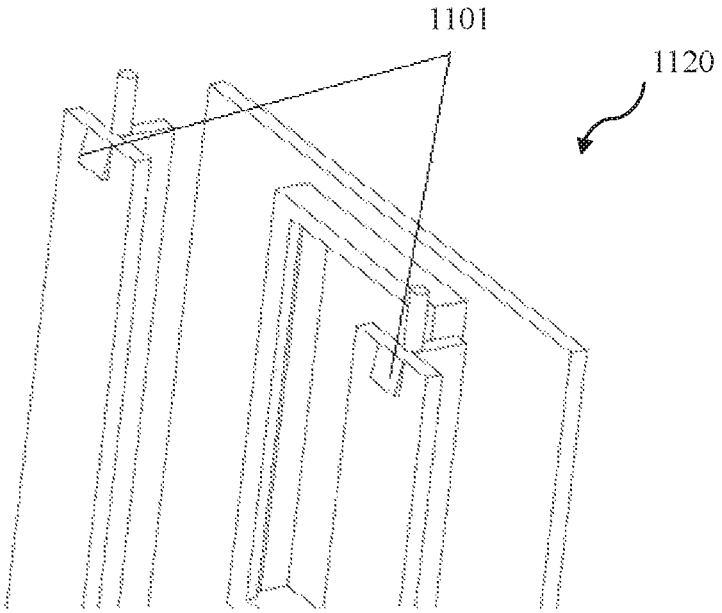

FIGS. 11A and 11B illustrate a part of a second housing 615 in accordance with some embodiments of the disclosed subject matter. As illustrated in FIGS. 11A and 11B, the second housing 615 further includes a bulge 1101. The bulge 1101 may be formed on an end of an upper housing portion 801. In one embodiment, as shown in FIG. 11A, the bulge 1101 is on the inner side of the upper housing portion 801. In another embodiment, as shown in FIG. 11B, the bulge 1101 is on the outer side of the upper housing portion 801. The bulge 1101 may be configured to stop the plug part 120 from being completely ejected from the housing.

The structures and functions described above in relation to the movable socket assembly 600 are not exhaustive and are not limiting; numerous other changes, substitutions, variations, alterations, and modifications may be ascertained to one skilled in the art and it is intended that the present disclosure encompasses all such changes, substitutions, variations, alterations, and modifications as falling within the scope of the appended claims.

What is claimed is:

1. An extendable socket assembly, comprising:

a housing;

a plug part comprising a flat insertion piece installed in the housing, wherein the plug part has an extended configuration and a retraced configuration, the flat insertion piece includes two insulation layers and three conducting strips, and the conducting strips are insulatively separated from each other and placed between the two insulation layers;

a lock assembly having a locked state and an unlocked state, wherein the lock assembly includes a movable element having a first position in the locked state and a second position in the unlocked state; and wherein the movable element is configured for controlling the transformation of the plug part from the retraced configuration to the extended configuration by moving the movable element from the first position to the second position.

2. The extendable socket assembly of claim 1, wherein the movable element is a button, wherein the first position is a position where the button isn't pressed and the second position is a position where the button is pressed.

3. The extendable socket assembly of claim 1, wherein the movable element is a lock key, wherein the first position is a position where the lock key is engaging a front notch and the second position is a position where the lock key is disengaging the front notch.

4. The extendable socket assembly of claim 1, wherein the plug part having a plurality of elastic conducting contact points.

5. The extendable socket assembly of claim 4, wherein each conducting strip of the three conducting strips penetrates one of the two insulation layers to form one of the plurality of elastic conducting contact points on a surface of the insulation layer.

6. The extendable socket assembly of claim 4, wherein the plurality of elastic conducting contact points are formed on a same side of the flat insertion piece.

7. The extendable socket assembly of claim 4, wherein the plurality of elastic conducting contact points are formed on different sides of the flat insertion piece.

8. The extendable socket assembly of claim 4, each elastic conducting contact point has one of a curved surface, a plane surface, a waved surface, or a stepped surface.

9. The extendable socket assembly of claim 1 further comprising an adjusting assembly configured for ejecting the flat insertion piece out of the housing for insertion of the flat insertion piece into an external power outlet.

10. The extendable socket assembly of claim 9, wherein the adjusting assembly comprising two springs for ejecting the flat insertion piece out of the housing along a slide guide.

11. The extendable socket assembly of claim 9, wherein the housing comprises a first housing and a second housing, and the second housing can retract into the first housing to extend the flat insertion piece out of the housing through an opening of the second housing.

12. The extendable socket assembly of claim 11, wherein the adjusting assembly comprising a spring for ejecting the second housing out of the first housing when the flat insertion piece is being removed from the external power outlet.

13. The extendable socket assembly of claim 11, wherein the second housing comprising a bulge for preventing the second housing from completely disengage the first housing, and wherein the bulge is formed at an end of the upper housing portion.

14. The extendable socket assembly of claim 9, wherein the second housing comprising an upper housing portion which has a safety unit mount part, a lower housing portion which has a socket core structure, and a bottom portion.

15. The extendable socket assembly of claim 1 further comprising a plurality of holes formed on a side of the housing for receiving an external plug.

16. The extendable socket assembly of claim 1 further comprising a safety unit, the safety unit comprising a gate installed between the plurality of holes and a plurality of conductors, a spring attached to the gate, and a slope formed on the gate, wherein when the external plug is inserted into the holes the external plug engages with the slope to push the gate aside so that the external plug can connect to the plurality of conductors.

17. The extendable socket assembly of claim 1, wherein the flat insertion piece comprising a bulge which stops the flat insertion piece from being completely ejected from the housing.

18. The extendable socket assembly of claim 1, wherein the housing comprises a chamber for installing a smart chip.

19. A method for inserting an extendable socket assembly into an external power outlet, comprising:

providing the extendable socket assembly, wherein the extendable socket assembly comprising a housing, a plug part comprising a flat insertion piece installed in the housing having an extended configuration and a retraced configuration, a lock assembly having a locked state and an unlocked state, wherein the flat insertion piece includes two insulation layers and three conducting strips, and the conducting strips are insulatively separated from each other and placed between the two insulation layers;

making the lock assembly from the locked state to the unlocked state to enable the plug part transform from the retraced configuration to the extended configuration;

getting the flat insertion piece ejecting out of the housing in the extended configuration; and inserting the extendable socket assembly into the external power outlet.

20. An extendable socket assembly, comprising:

a housing comprising a plurality of holes formed on a side of the housing for receiving an external plug;

a plug part installed in the housing;

three conducting strips which are insulatively separated from each other and a plurality of elastic conducting contact points formed on the plug part;

a lock assembly for locking or unlocking the plug part so that the plug part can be removable inside or outside of the housing; and an adjusting assembly configured for ejecting the flat insertion piece out of the housing for insertion of the flat insertion piece into an external power outlet.

* * * * *